US005961431A

United States Patent [19]

Coullery et al.

[11] Patent Number: 5,961,431

[45] Date of Patent: Oct. 5, 1999

[54] DEVICE FOR TURNING THE FRONT PANEL OF A PLATE-LIKE WORKPIECE WITHIN A FOLDER-GLUER

[75] Inventors: Gerard Coullery, Villars-le-Terrior; Jean-Louis Wenger, Grandvaux, both of Switzerland

[73] Assignee: Bobst S.A., Lausanne, Switzerland

[21] Appl. No.: 09/018,685

[22] Filed: Feb. 4, 1998

[30] Foreign Application Priority Data

Feb. 7, 1997 [CH] Switzerland ..... 0269/97

[51] Int. Cl.[6] ..... B31B 1/02

[52] U.S. Cl. ..... 493/177; 493/182; 493/183; 493/437; 493/453

[58] Field of Search ..... 493/177, 182, 493/183, 437, 438, 436, 453, 461, 417, 457, 180, 181

[56] References Cited

U.S. PATENT DOCUMENTS

| | | | |
|---|---|---|---|
| 1,505,178 | 8/1924 | Wade et al. | 493/177 |
| 2,197,089 | 7/1940 | Anderson | 493/177 |
| 2,354,251 | 7/1944 | Fiore | 270/68 |
| 2,765,713 | 5/1956 | Anness | 493/177 |
| 2,774,286 | 12/1956 | Bombard | 493/177 |
| 3,168,017 | 2/1965 | Frei | 270/83 |
| 3,405,611 | 10/1968 | Millich | 493/177 |
| 3,785,636 | 1/1974 | Bitting et al. | 270/69 |
| 4,052,932 | 10/1977 | Huiskes . | |
| 4,279,611 | 7/1981 | Labombarde et al. | 493/418 |
| 4,432,745 | 2/1984 | Eldridge | 493/10 |

*Primary Examiner*—Joseph J. Hail, III
*Assistant Examiner*—Dermott J. Cooke
*Attorney, Agent, or Firm*—Allen N. Friedmawn; McCarter & English, LLP

[57] ABSTRACT

The device for turning a front panel of a platelike workpiece within a folder-gluer comprises a retaining plate 20 extending across and somewhat above the traveling plane of the workpiece and a series of lifting fingers 30 positioned transversely below the travelling plane and somewhat upstream of the retaining plate 20. The lifting fingers are actuated by a piston from a resting position below the travelling plane to a raised slanted raised position, at the arrival of the blank's front panel. The front panel includes a partially separated flap that must be parted. The device also comprises at least one pusher 40 that is substantially perpendicular to the plate 20, the pusher 40 being actuated by an actuator 44 in order to separate the flap when the panel reaches maximum height against the plate 20.

9 Claims, 5 Drawing Sheets

DEVICE FOR TURNING THE FRONT PANEL OF A PLATE-LIKE WORKPIECE WITHIN A FOLDER-GLUER

FEDERALLY SPONSORED RESEARCH

This application claims priority from Swiss application Switzerland No. 0269/97.

BACKGROUND OF THE INVENTION

1. Field of the Invention

The present invention relates to a device for turning the front panel of a plate-like workpiece within a folder-gluer, that is to say a machine processing plate-like workpieces, such as cardboard or paper blanks, into "flat folded" and piled up boxes. These boxes can be rapidly converted into three dimensions afterwards. The blank size, as well as the creasing lines positioning the subsequent foldings, define the front and rear panels, the lateral panels, the bottom and cover elements of the box and, if required, the inner partitions. Some panels may also be provided with glue flaps.

The invention more particularly relates to a device for turning a rather large front panel of a blank, i.e. folding this panel from front to the rear, with respect to the travelling direction of the blank within the folder-gluer. Such a turning action of the front panel proves to be necessary, for example, when manufacturing record sleeves.

2. Brief Description of the Background Art

The turning of a small front flap is effected in a known manner by a device which is rather simple, comprising one or more hooks hanging in elastic manner from a crossbar, the lower end of these hooks being located in the travelling plane of the blanks.

The document FR 2,306,075 (corresponding to U.S. Pat. No. 4,052,932) describes an example of a known device for turning a larger front panel. This device comprises, on one hand, a folding crossbar located slightly above the travelling plane of the blanks, and whose horizontal V-shaped cross section is directed opposite to the travelling direction of the blanks. This device comprises, on the other hand, a series of lifting fingers located upstream of the crossbar and below the travelling plane and parallel to the crossbar. The fingers are actuated before the arrival of a blank by a piston, from an initial position below the plane to a raised slanted position directed towards the top of the crossbar. This operation may also be achieved by an air jet. As soon as the leading edge of the front panel is engaged above the crossbar, the fingers are brought back in to the lower position. The creasing line delimitating the rear edge of the front panel, remains flat on the lower conveyor. This creasing line yields to form a fold when arriving at the position of the crossbar. The front panel then is rapidly tilted by the stopping action of the crossbar onto the following intermediate panel. Then two panels pass together under the crossbar and into a calendar finishing the folding operation.

Folder-gluers are also known in which the turning device includes an upper vertical division plate associated with a lower upstream series of lifting fingers. In order to prevent the front part of the front panel from rebounding when ascending, possibly causing a premature folding, the upstream delivery side of the plate is provided with several vertical sliding rails held in front of the plate with a spacing slightly greater than the thickness of the blank. These sliding rails have the form of vertical bars whose lower ends are bent in the upstream direction in order to facilitate the engagement of the leading edge of the front panel, guided by the slanted lifting fingers. Moreover, the outlet of the upper upstream conveyor is positioned at a chosen distance with respect to the plate in such a manner that the front panel, initially arriving in the horizontal position, can bend in order to raise into the vertical position against the plate without breaking, but such that the rear creasing line immediately yields to produce a fold upon arrival at that position. This fold pass under the plate in order to be seized afterwards by the downstream conveyor, the front panel being then pulled downwards and pushed against the following intermediate panel.

SUMMARY OF THE INVENTION

While working satisfactorily in many instances, folder-gluers provided with these prior art devices reach their limits when the front panel or panels to be turned include, in addition, one or more flaps initially retained by bridges or partial cuts distributed along the C-shaped, U-shaped or otherwise shaped periphery of the flaps. These flaps must be parted before completion of the turning operation. Such front panels with flaps are, for example, used in the case of blanks for special boxes used in transporting beer-bottles, the front panels and their flaps being destined to be formed into inner partitions kept in position by glue flaps.

Now, such a parting operation of weak holding points, in the form of small bridges, is related to the waste stripping operation usually performed on a plate where the blank is momentarily stopped to permit lowering and raising of a suitably designed tool similar to a punch. However, such a machine stoppage is hardly compatible with the continuous folding operations executed at high speed in folder-gluers of the present invention, particularly at the position of the turning operation, which is one of the first operations.

The aim of the present invention is a device for turning the front panel of a plate-like workpiece that is equipped to part one or more flaps in a front panel having to be turned, and performing this operation in a manner that is compatible with high speed operation of the machine and, as much as possible, without requiring heavy, complicated, and hence onerous equipment.

These aims are achieved by use of the herein disclosed inventive device for turning the front panel of a plate-like workpiece within a folder-gluer. This device comprises a substantially vertical retaining plate positioned transversly somewhat above the travelling plane of the blanks, retaining sliding guides parallel to and position upstream of the retaining plate, and a series of lifting fingers positioned transversally below the travelling plane and upstream of the retaining plate. This series of lifting fingers is rotated by a pneumatic cylinder or equivalent actuating device from a rest position below the plane of travel to a substantially slanted raised position at the arrival of the front panel, in order to direct the panel to the vertical retaining plate and behind the retaining sliding guides. This device also comprises at lease one pusher that is substantially perpendicular to the plate, this pusher being actuated by an actuator in order to separate the flap when the panel reaches its maximum height against the plate.

The longitudinal travelling direction of the blanks being taken as reference, the terms "upstream" and "downstream" define, respectively, directions toward the start of travelling, generally the feeding station, and toward the destination, in this case the delivery and piling station. In a similar manner, the term "transverse" means a line that is perpendicular to the travelling direction and parallel to the plane of the blank. The term "vertical" refers to a line which is perpendicular to the plane of the blanks and the traveling direction.

In an exemplary device, the front panel of the blank remains against the plate as it reaches close to its "maximum" vertical position during the time that the creasing line reaches the level of the lower conveyor, creases, and then converts into a folding engagement under the plate. This fold formation time typically corresponds to a forward motion of about 5 cm of the creasing line at the level of the plate. It is during this forward motion that the panel, pushed against the plate, remains at an almost constant height. This fold formation time is just enough for a pusher to be moved forward and backward by a commercially available rapidly acting actuator.

Advantageously, the device includes several pushers fitted on a common small plate actuated by the actuator. More particularly, this small plate may include a plurality of threaded holes allowing arrangement of the pushers to correspond to the form and the dimensions of the flap or flaps.

Alternatively, the device comprises, for each flap, a single pusher, whose action surface approximately corresponds to the shape of the flap being parted. In that case, such a pusher corresponds to a kind of punch.

Usefully, the action surface of the pusher or pushers facing a flap is sloped, extending further at the top of the flap and extending less at the folding position of the flap.

According to a first embodiment, the pusher or pushers are located at apertures across the retaining plate and are actuated in the upstream direction. Usefully then, the plate may have a plurality of apertures corresponding to the plurality of threaded holes of the small plate permitting the pushers to be selectively located to correspond to the size and location of the flaps.

Usefully then, the sliding retaining guides parallel to the retaining plate are shaped to form an upper and lateral frame for each flap. Such a frame provides better support for the panel against the retaining plate when the flaps are parted by the pushers.

According to a second embodiment, the retaining plate has apertures corresponding to each flap, and the pusher or pushers are actuated in a downstream direction. Each aperture has a rounded lower edge to close the parted flap.

Advantageously, the actuators may be pneumatic or electromagnetic. They may be positively driven in both directions or may be positively outwardly driven and then retracted by means of a spring.

The invention will be better understood by the study of an embodiment taken by way of nonlimiting example and illustrated by the attached drawings.

DETAILED DESCRIPTION OF THE INVENTION

Figure 1:
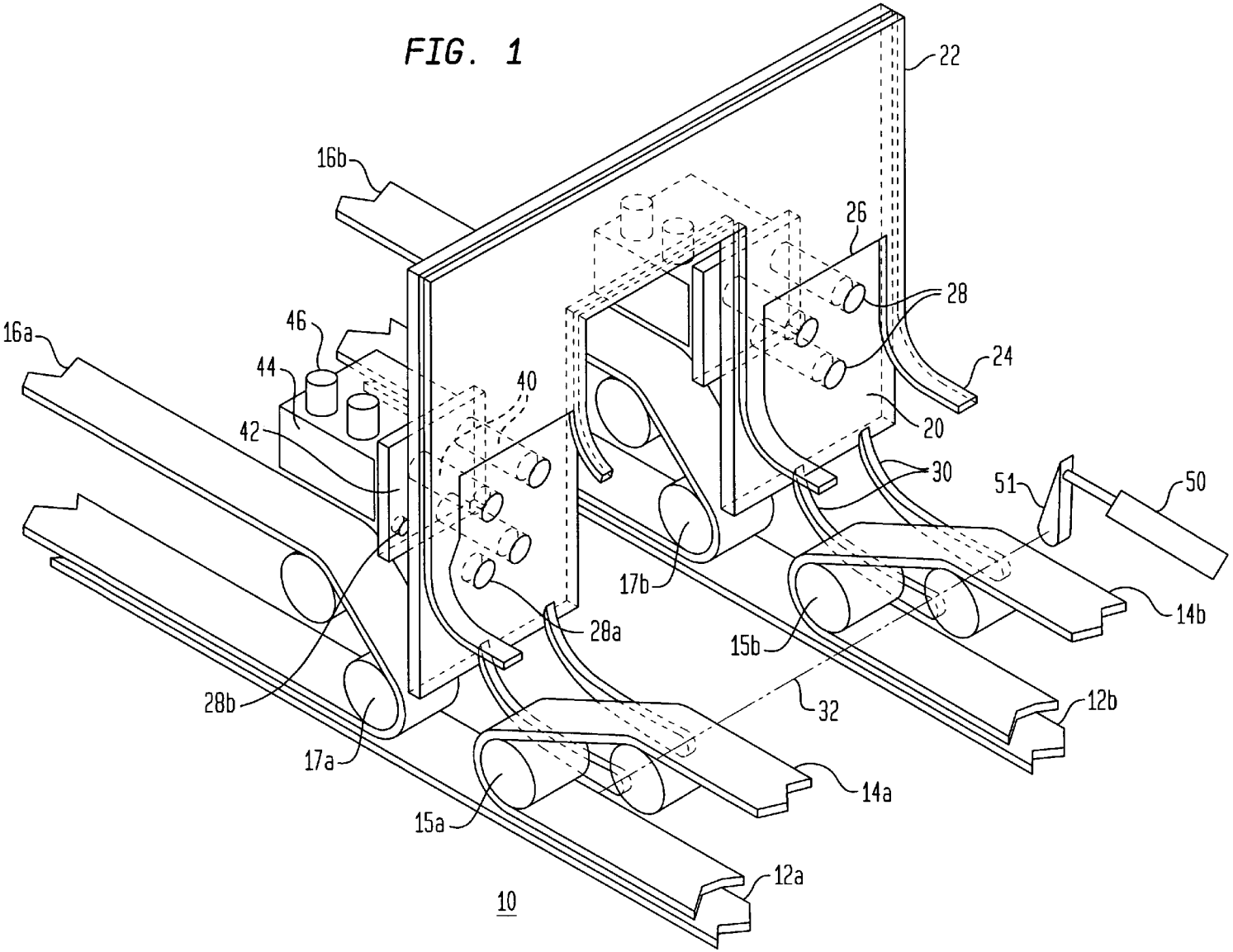
FIG. 1 is a perspective view of a turning device.

FIG. 1 illustrates a device for turning a blank's front panels, the device possessing a vertical retaining plate 20, positioned transversely somewhat above a conveyor 10 of blanks and provided with lifting fingers 30 arranged slightly upstream of the plate 20 and under the conveyor 10.

In this example, the lower part of the conveyor 10 consists of two parallel endless belts 12*a* and 12*b*, the outer return and drive pulleys of which are not shown. Corresponding to the lower belts 12*a*, 12*b* the conveyor 10 includes first pair of upper endless belts 14*a* and 14*b* located upstream of the plate 20 and whose downstream return pulleys 15*a*, 15*b* are located rather near the plate, for example, at a spacing of 5 to 25 cm from the plate 20, the wider spacing needed for the turning of thicker blanks. The conveyor 10 also includes a second pair of endless belts 16*a*, 16*b* downstream of plate 20. The upstream return pulleys 17*a*, 17*b* of these downstream belts 16*a*, 16*b* are located adjacent to the plate 20 to facilitate capturing of the folded blank. The upper belts 14*a*, 14*b*, 16*a*, 16*b* press the blanks against the lower conveyor 12*a*, 12*b* in order to provide a drive and a forward motion of these blanks, with neither lateral nor slantwise skidding or shifting.

In this example, the retaining plate 20 has a substantially rectangular transverse form with a notch in the lower median part, this rectangular notch being vertically disposed. This notched plate thus allows turning of two laterally placed front panels of a blank while leaving enough space for another operation, such as lateral folding of a median front panel. The transverse length of this plate 20 substantially corresponds to the width of the blank. The lower edge of this plate 20 is located above the lower conveyor belts 12*a*, 12*b* and, preferably, above the axis of the return pulleys 17*a*, 17*b*.

More particularly according to the invention, a retaining and framing slide plate 22 is fixed facing the upstream side of the retaining plate 20 with a spacing slightly larger than the thickness of the blank to be processed. This exemplary slide plate 22 has, like the retaining plate 20, a central notch leaving free passage for a median front panel to receive additional processing. On the other hand, according to the invention, each lateral panel of this slide plate 22 has a framing window 26 whose vertical and transverse dimensions correspond to the dimensions of the flaps to be opened within the front panels being turned. Moreover, the lower ends of the window framing members have the form of sliding guides 24, arc-shaped in the upstream direction, ensuring guiding of the panels in the manner to be shown below. These retaining plates 20 and slide plates 22 can be made out of steel any other material providing adequate rigidity.

In addition, the turning device includes a series of lifting fingers 30 whose upstream ends are mounted on a common axle 32 that is rotated by means of at least one actuator, for example, by a pneumatic cylinder 50 connected to a lever 51 affixed to the common axle 32. The downstream ends of the lifting fingers 30 are upwardly arc-shaped while being located upstream of the retaining plate 20 by approximately half the protruding length of the sliding guides 24. By rotating the common axle 32, these lifting fingers 30 can be brought from a first rest position under the travelling plane of the conveyor 10 to a second slanted active position in which the arc-shaped downstream ends emerge upwardly with respect to the travelling plane of the blanks on the conveyor 10.

Figure 3:
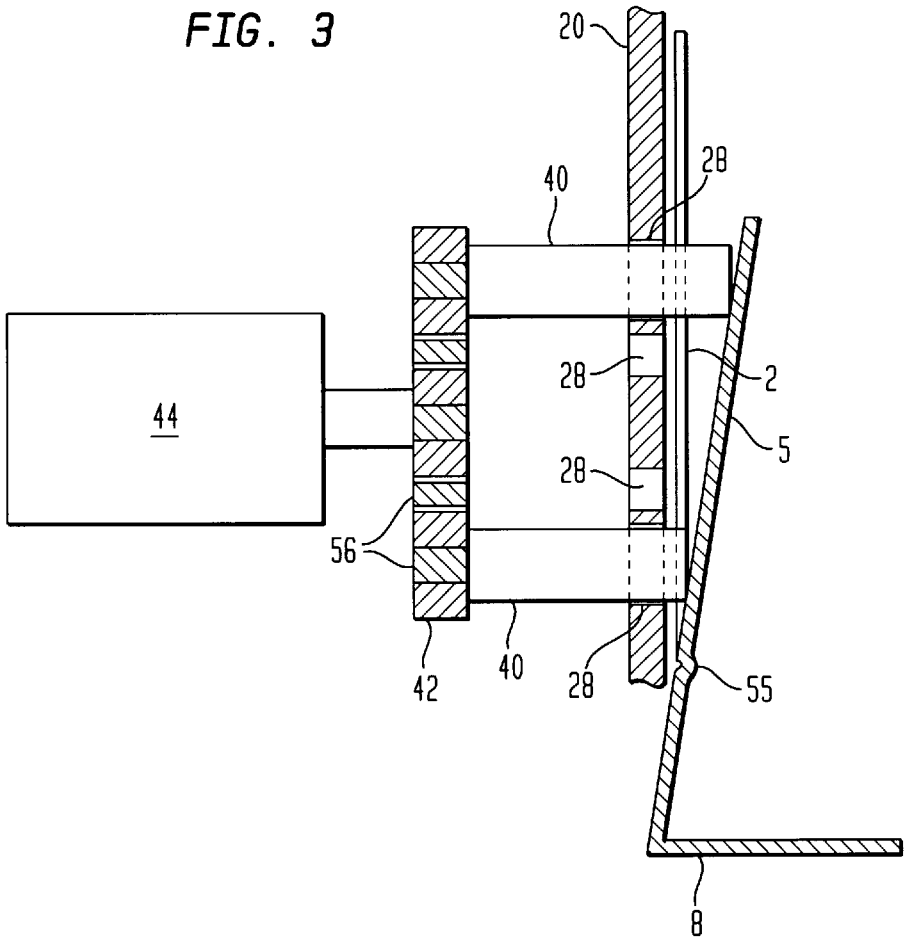
FIG. 3 is an elevational view in section showing an embodiment of the pushers acting in a slanted manner against the flap of a plate-like workpiece.
Figure 4:
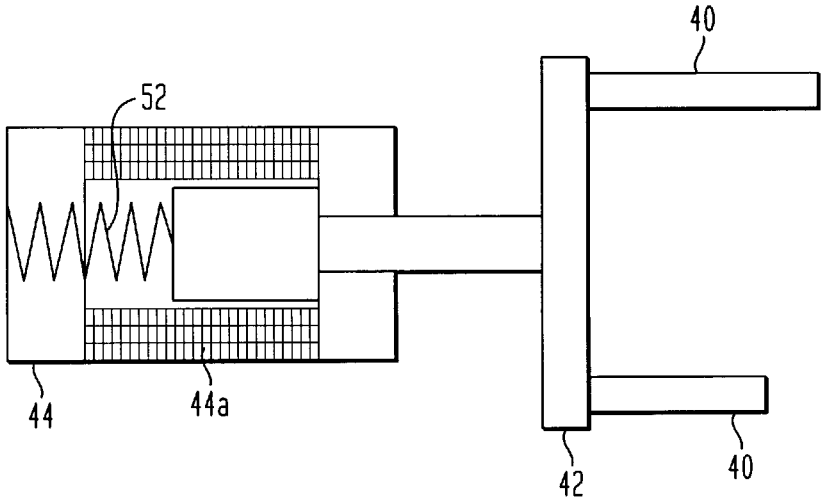
FIG. 4 is an elevational view, in partial section, showing an embodiment of a single acting actuator that has an electromagnetically actuated cylinder being driven forward but being retracted by a spring to bring it back to its rest position.

In an exemplary embodiment according to the invention, each lateral panel of the retaining plate 20 includes an array of apertures 28 in each of which a pusher 40 can slide through the retaining plate 20. On the downstream side of the plate, the rear ends of the pushers 40 are fixed in groups to common small plates 42 affixed to actuators 44 intended to impart a rapid upstream/downstream linear movement to each pusher 40. The length of the pushers may be identical so that all of them are even with the upstream surface of the plate 22. Preferably, as illustrated in FIG. 3, the length of the pushers that are near the lower folding line 55 (the crease line) of the flap 5 are shorter than the length of the upper pushers, so as to provide a generally slanted action surface, more compatible with the geometry of the open flap. These actuators 44 may be double-acting, driven in both forward and backward directions either electromagnetically or by pneumatic cylinders, or single acting, as illustrated in FIG. 4 for example, being driven forward but being retracted by springs 52 to bring them back to the rest position. The illustrative pneumatic actuators 44 are connected to an air source by connectors 46. FIG. 4 also illustrates use of an electromagnetic coil 44*a* to drive the actuator forward.

Such as described, the turning device according to the invention operates in the following manner.

Figure 2B:
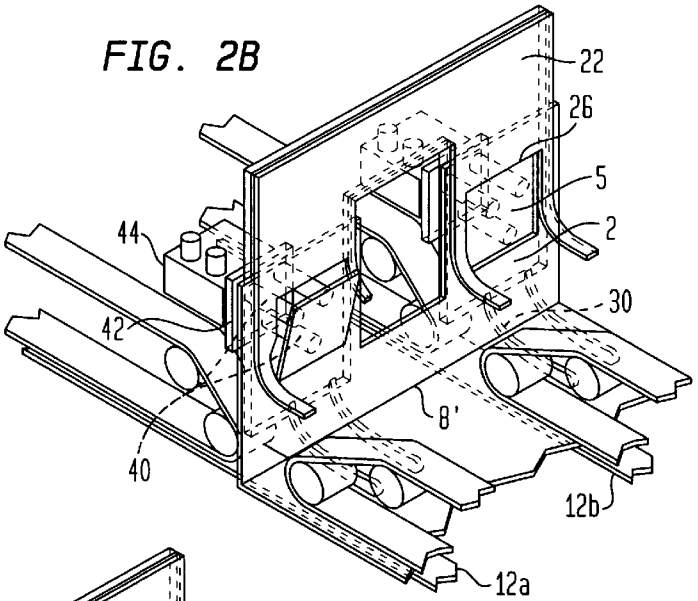
Figure 2C:
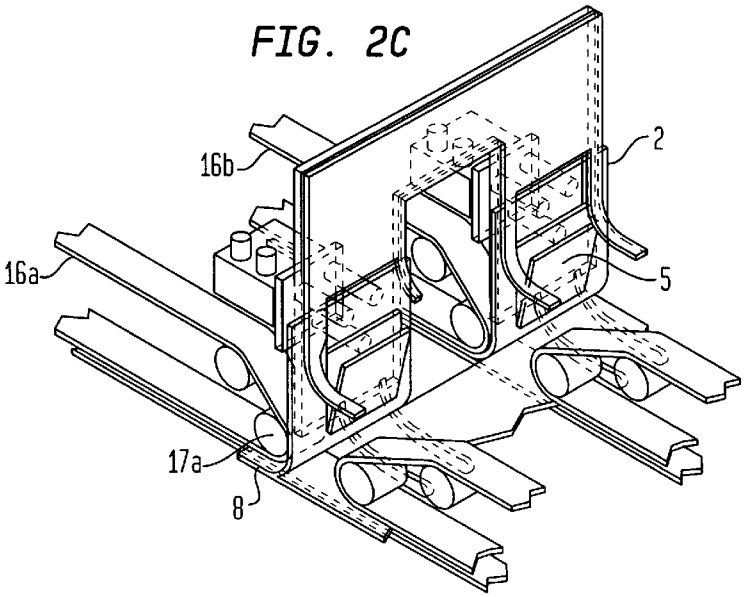
Figure 2A:
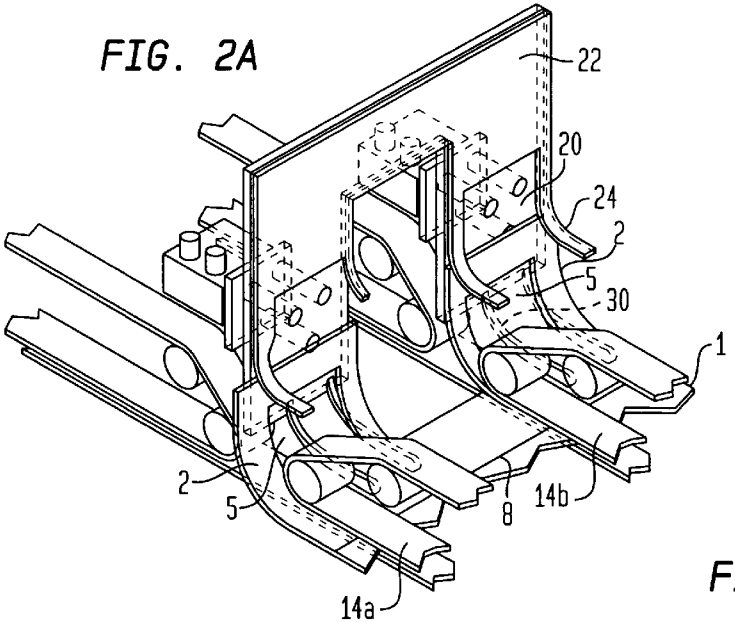

FIG. 2*a* illlustrates a blank 1 having two lateral front panels 2, each panel including a flap 5 to be opened.

The FIG. 2*a* illustrates the arrival of the blank 1 in the device, a phase during which the lifting fingers 30 are in a raised position in order to direct the front edges of the panels 2 under the sliding guides 24, hence between the slide plate 22 and the retaining plate 20. During this phase, the creasing line 8 delimitating the rear edge of the panels 2 is still within the upstream conveyor 14*a*, 14*b*. The front panels 2 then rise against the plate 20 by passing arc-shaped without folding between the conveyor 10 and the plate 20.

FIG. 2*b* illustrates the phase in which the creasing line 8, having left the upstream conveyor, becomes folded 8'. Shortly before the folding occurs, the lifting fingers 30 have returned to their retracted position below the conveyors 10 so that the folding line 8' remains in contact with the lower endless belts 12*a*, 12*b*.

As may be seen on the right part of FIG. 2*b*, the flap 5 of the panel 2 is in the window 26 of the slide plate 22. Then, and as better seen on the left part of FIG. 2*b*, the actuator 44 moves the small plate 42 forward to the plate 20, so that the ends of the pushers 40 protrude from the upstream surface of plate 20 in order to open the flap 5 by parting the retaining bridges. The pushers 40 are then immediately retracted. The protrusion and retraction take place as the creaseline 8, 8' moves approximately 5 centimeters and the panels 2 are at their maximum height.

FIG. 2*c* illustrates the ejection phase in which the fold 8' is captured by the downstream conveyors 16*a*, 16*b* thus forcing a lowering of the panels 2 with their open flaps 5. Importantly, the curvature imposed on the panel 2 occurring at the level of the return pulleys 17*a* momentarily confirms the opening of the flaps before their closing when the panels 2 are pressed against the following part of the blank.

As may have been gathered at the reading of the foregoing, the turning device according to the invention executes an opening operation of flaps by breaking weak points "on-the-fly" simultaneously with a turning operation of blank's front panels. As compared to prior art devices, the device of the invention incorporates an improvement of the sliding rails in the form of a retaining and framing plate 22 provided with lower arc-shaped guides 24 and the addition, at a place which has been appropriately chosen, of pushers 40 actuated by rapid actuators 44. Preferably, this device is controlled by a microprocessor control that release the pushers either at a predetermined "machine-degree", or at the receipt of a sensor signal verifying the arrival of the front panel 2 of the blank as it approaches its maximum height against the retaining plate 20.

Operating safety margins are defined when locating the pushers 40 with regard to the upper edge of the windows 26 by taking into account the rapidity of action of the actuators 44. Particularly, the use of more rapidly acting actuators permits the use of relatively long pushers, located nearer the upper edge of the windows 26 so as to assure a clean parting of the flaps 5.

The invention has been illustrated with flaps whose folding lines are at their lower end, but, with suitable equipment design, flaps with lateral, right, left or upper folding lines are also handled by the invention.

Figure 1A:
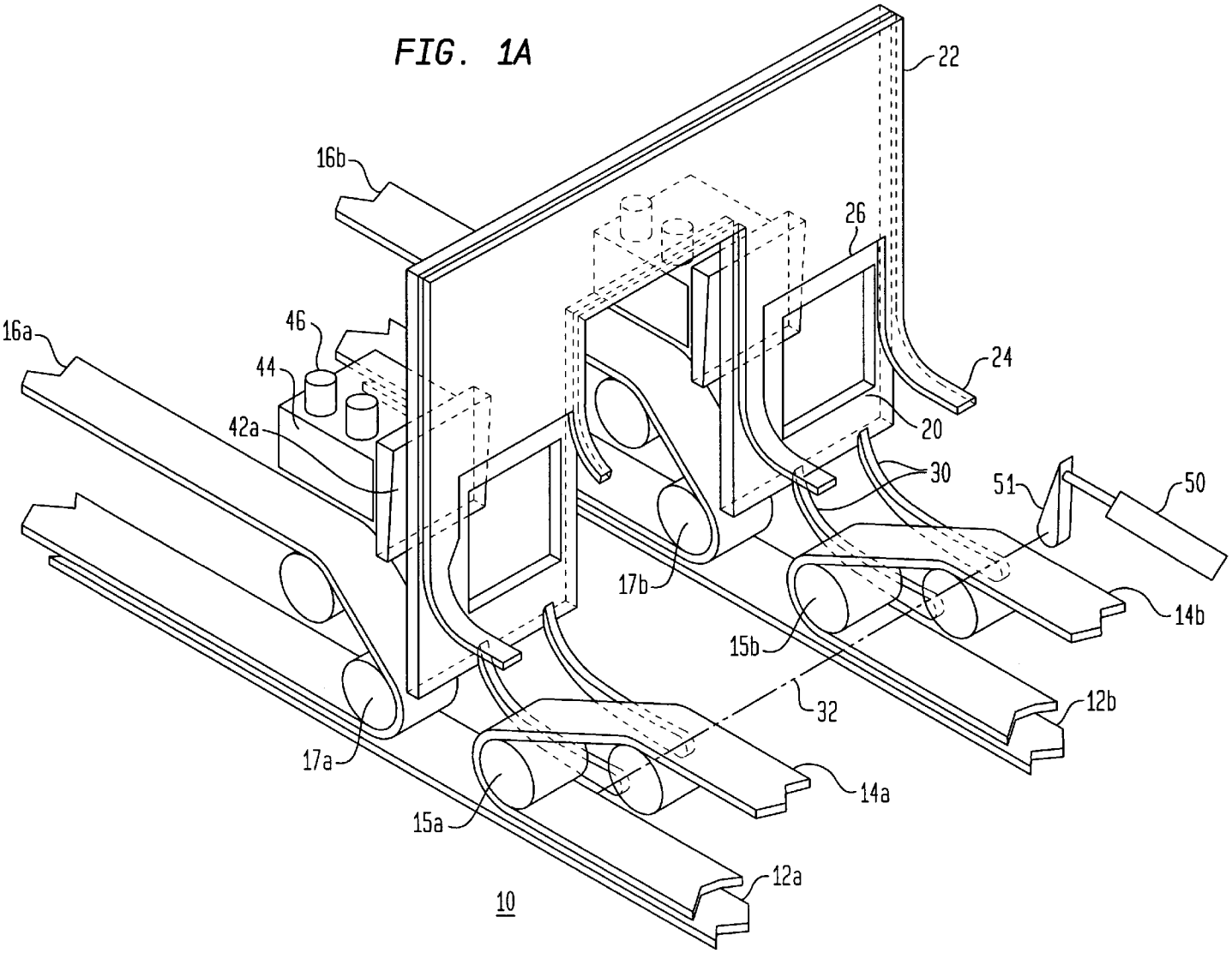
FIG. 1*a* is a perspective view of a first alternate embodiment of the turning device of FIG. 1.
Figure 1B:
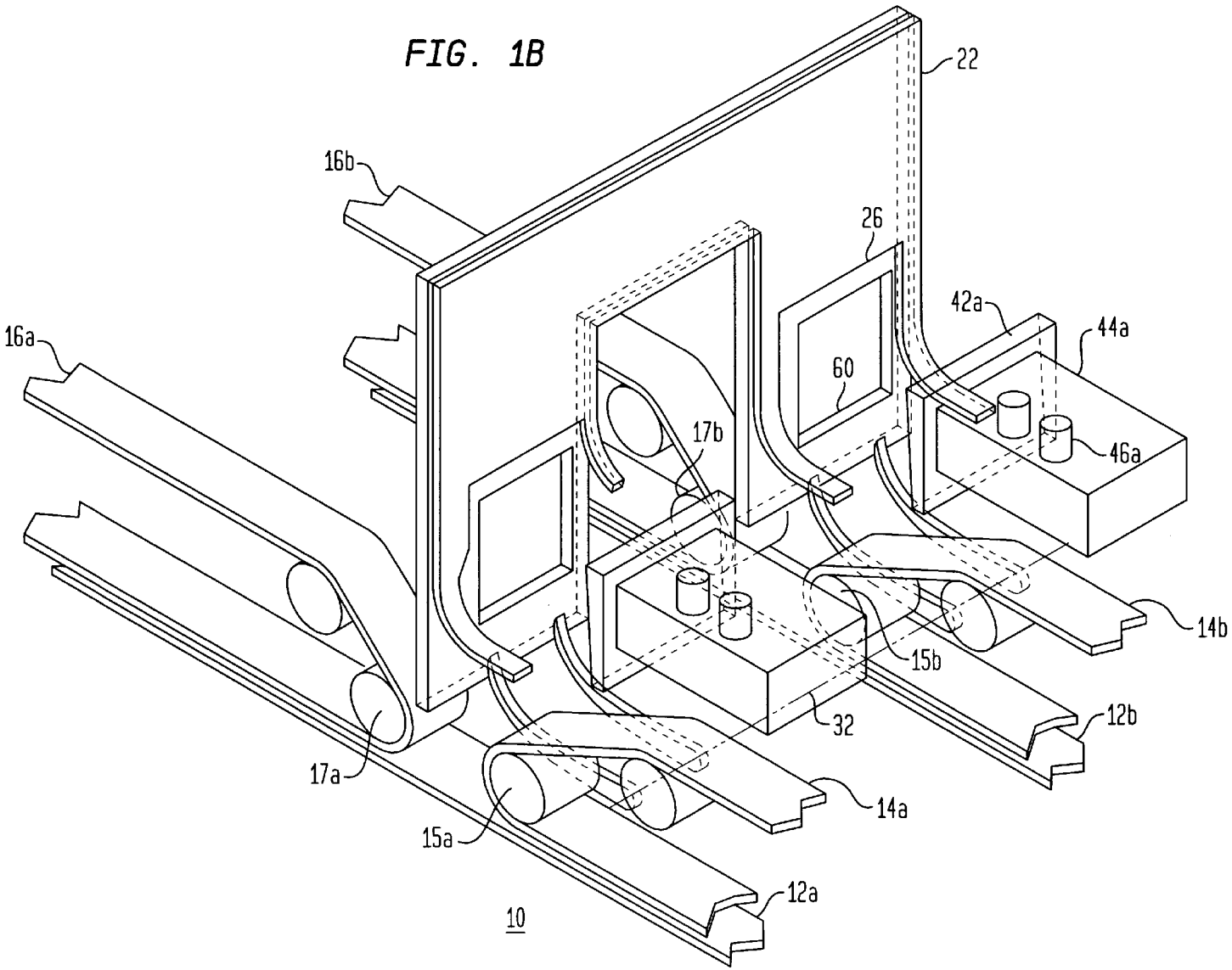
FIG. 1*b* is a perspective view of a second alternate embodiment of the turning device of FIG. 1, FIGS. 2*a*, 2*b*, and 2*c* are perspective views illustrating three successive stages of the turning action of a blank's front panel by the device of FIG. 1.

Alternatively, as illustrated in FIG. 1*b*, it is also possible that the actuator 44*a* and the small plate 42*a* are located upstream of the plate 20, therefore the pushers 40 move forward in a downstream direction into windows arranged in the retaining plate 20, corresponding to the flaps. Preferably then, a smooth bulge 60 is provided along the lower edge of such a window, so that the flap can be restored to its position within the panel at the time of its ejection and turning. FIG. 1*a* illustrates use of a sloped pusher 42*a*, whose action surface is in the approximate shape of the flap being parted. FIG. 1*b* illustrates use of a pusher 42*a* actuated in the downstream direction, in which case, the lower edge of the window 26 is rounded or has a smooth bulge 60. FIG. 3 shows a small plate 42 with an array of threaded holes 56 corresponding to holes 28 in the retaining plate 20, some of which are occupied by pushers 40, as needed for parting of the particular flap 5. This is also shown as elements 28*a* and 28*b* of FIG. 1. Other variations can be provided by the person skilled in the art within the scope of the following claims.

We claim:

1. A device for turning a front panel (2) of a flat workpiece (1) having a flap and along conveyor belts (12*a* & 12*b*) in a plane towards a transversely vertical retaining plate (20) within a folder-gluer and parting said flap in the front panel, this device comprising retaining sliding guides (22, 24), said vertical retaining plate (20) located transversly to the traveling direction above the travelling plane of the workpiece (1), wherein said vertical retaining plate or said retaining sliding guides form window openings having at least 3 sides through which a parted flap may be pushed, retaining sliding guides (22, 24), and a series of lifting fingers (30) located transversely to the traveling direction, below the travelling plane, and upstream of the retaining plate (20), this series lifting fingers (30) being fixed to a common shaft (32) and adapted to being raised by at least one actuator (50) from a rest position below the travelling plane to a slanted raised position at the arrival of the workpiece 5 front panel, in order to direct the front panel onto the retaining plate (20) and behind the retaining sliding guides (22, 24), the device further comprising at least one pusher (40) that is perpendicular to the retaining plate (20) and adapted to being linearly actuated by an actuator (44) in order to part a flap (5) of the front panel (2) when the latter passes near its maximum vertical position against the retaining plate (20) by actuatin and extending said pushers through said window openings while engaging said flaps.

2. The device according to claim 1, comprising a plurality of pushers (40) mounted on a common small plate (42), adapted for being linearly actuated by the actuator (44) to engage and part said flaps from said workpiece's front panel by actuating and extending said pushers through said window openings in said vertical retaining plate or said retaining sliding guides.

3. The device according to claim 1 comprising, for each flap (5), a single pusher **(42*a*)** provided with an action surface corresponding to the flap's surface.

4. The device according to claim 1, in which the action surface of the pusher **(42*a*), facing a flap (5), is slanted, the action surface's edge which is least protuberant being nearest to the flap's fold line (55)**.

5. The device according to claim 1 in which a plurality of pushers (40) is positioned in correspondence with an array of apertures (28) of the retaining plate (20) and are adapted to being actuated in an upstream direction.

6. The device according to claim 1, including sliding guide rails (22, 24) forming an upper and lateral framing window (26) for each flap (5).

7. The device according to claim 1, in which the retaining plate (20) is provided with a window including a rounded lower edge (60) corresponding to each flap (5), and in which the pushers **(42*a*)** are adapted to being actuated in a downstream direction through the window.

8. The device according to claim 1, in which the actuator (44) is actuated pneumatically or electromagnetically, by a double-acting mechanism adapted to being driven both forward and backward.

9. The device according to claim 1, in which the actuator (44) is actuated pneumatically or electromagnetically by a single-acting mechanism driven forward, the backward motion being provided by a spring.

* * * * *